US005406022A

United States Patent [19]

Kobayashi

[11] Patent Number: 5,406,022

[45] Date of Patent: Apr. 11, 1995

[54] METHOD AND SYSTEM FOR PRODUCING STEREOPHONIC SOUND BY VARYING THE SOUND IMAGE IN ACCORDANCE WITH TONE WAVEFORM DATA

[75] Inventor: Ikuo Kobayashi, Hamamatsu, Japan

[73] Assignee: Kawai Musical Inst. Mfg. Co., Ltd., Shizuoka, Japan

[21] Appl. No.: 862,189

[22] Filed: Apr. 2, 1992

[30] Foreign Application Priority Data

Apr. 3, 1991 [JP] Japan ..... 3-071256

[51] Int. Cl.[6] ..... G10H 7/00; G10H 1/06

[52] U.S. Cl. ..... 81/622; 84/626; 84/DIG. 27

[58] Field of Search ..... 84/600, 622, 626, DIG. 27

[56] References Cited

U.S. PATENT DOCUMENTS

| | | | |
|---|---|---|---|
| 4,602,546 | 7/1986 | Shinohara . | |
| 5,027,689 | 7/1991 | Fujimori | 84/622 |
| 5,048,390 | 9/1991 | Adachi et al. | 84/626 X |
| 5,095,798 | 3/1992 | Okada et al. | 84/DIG. 27 X |
| 5,119,712 | 6/1992 | Kato | 84/626 |
| 5,153,362 | 10/1992 | Toda et al. | 84/625 |
| 5,159,140 | 10/1992 | Kimpara et al. | 84/600 |

*Primary Examiner*—William M. Shoop, Jr.
*Assistant Examiner*—Jeffrey W. Donels

[57] ABSTRACT

A device for use in an electronic musical instrument, in which a sound image is varied according to musical factors of musical tones. For example a sound image position, a number of sound images and/or a sound image shift pattern are varied according to a sounding order, a sound part, a tone color and/or effects. In this way, the sound image can be varied according to the contents of musical tones to realize play with a high spatial impression.

39 Claims, 14 Drawing Sheets

| DRUM | |
|---|---|
| TONE COLOR (TONE NUMBER) | SOUND IMAGE POSITION |
| BASS DRUM | CR |
| SNARE DRUM | CL |
| CLOSING OF HIGH HAT | L2 |
| OPENING OF HIGH HAT | L2 |
| CYMBAL | R1 |
| HIGH TAM | L2 |
| MID TAM | CR |
| LOW TAM | R2 |
| ⋮ | ⋮ |

FIG. 10A

| TONE IMAGE POSITION ASSIGNMENT CONTENTS MELODY 1 (CHORUS EFFECT "ON") | |
|---|---|
| SOUNDING ORDER DATA "ORDER" | SOUND IMAGE POSITION |
| 0 | L 1 |
| 1 | R 1 |
| 2 | C L |
| 3 | C R |
| 0 | L 1 |
| ⋮ | ⋮ |

FIG. 10B

| MELODY 2 (CHORUS EFFECT "OFF") | |
|---|---|
| SOUNDING ORDER DATA "ORDER" | SOUND IMAGE POSITION |
| 0 | L 3, R 3 |
| 1 | L 2, R 2 |
| 2 | L 1, R 1 |
| 0 | L 3, R 3 |
| ⋮ | ⋮ |

FIG. 10C

| CHORD | |
|---|---|
| SOUNDING ORDER DATA "ORDER" | SOUND IMAGE POSITION |
| 0 | L 3, R 3 |
| 1 | L 2, R 2 |
| 0 | L 3, R 3 |
| ⋮ | ⋮ |

FIG. 10D

| BASS | |
|---|---|
| SOUNDING ORDER DATA "ORDER" | SOUND IMAGE POSITION |
| — | C L |

STEP 07, 114

METHOD AND SYSTEM FOR PRODUCING STEREOPHONIC SOUND BY VARYING THE SOUND IMAGE IN ACCORDANCE WITH TONE WAVEFORM DATA

BACKGROUND OF THE INVENTION

1. Field of the Invention

This invention relates to a stereophonic sound system and a method for generating a stereophonic sound, and more particularly, to a stereophonic sound system and a method for generating a stereophonic sound in which the reproduction of a sound is varied by the use of musical tone data.

2. Description of the Background

As a system for artificially producing a stereophonic sound from a monaural sound, a panpot is well known in the field of electronic musical instruments. The panpot effects a shift of the reproduction of a sound by producing a left signal and a right signal from a monaural sound signal and varying the gain thereof with an attenuator. The attenuator gain variation is effected by manually operating a lever or the like coupled to the attenuator.

The use of a panpot, however, means that the sound must be varied by a manual operation, and thus it is very difficult to vary the sound according to the content of the musical tone data.

A circuit similar to the circuit shown in FIG. 8 of the present application is disclosed in specification of U.S. patent application serial No. 07/813,933.

SUMMARY OF THE INVENTION

An object of the invention is to provide a stereophonic sound system and a method for generating a stereophonic sound by which a sound can be automatically varied according to the content of musical tone data.

To attain this object, according to the present invention, the sound is varied in accordance with musical factors of musical tones. More specifically, sound data is generated and made stereophonic, the musical factors thereof are detected to generate stereophonic data, and the sound formed from the sound data is varied in accordance therewith. Therefore, a sound can be varied according to the content of musical tone data and a high spatial impression can be realized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein:

FIGS. 10A–10D are views showing the assignment of sound image positions for various parts of a sound;

DESCRIPTION OF THE PREFERRED EMBODIMENTS

Summary of the Embodiments

Figure 6:
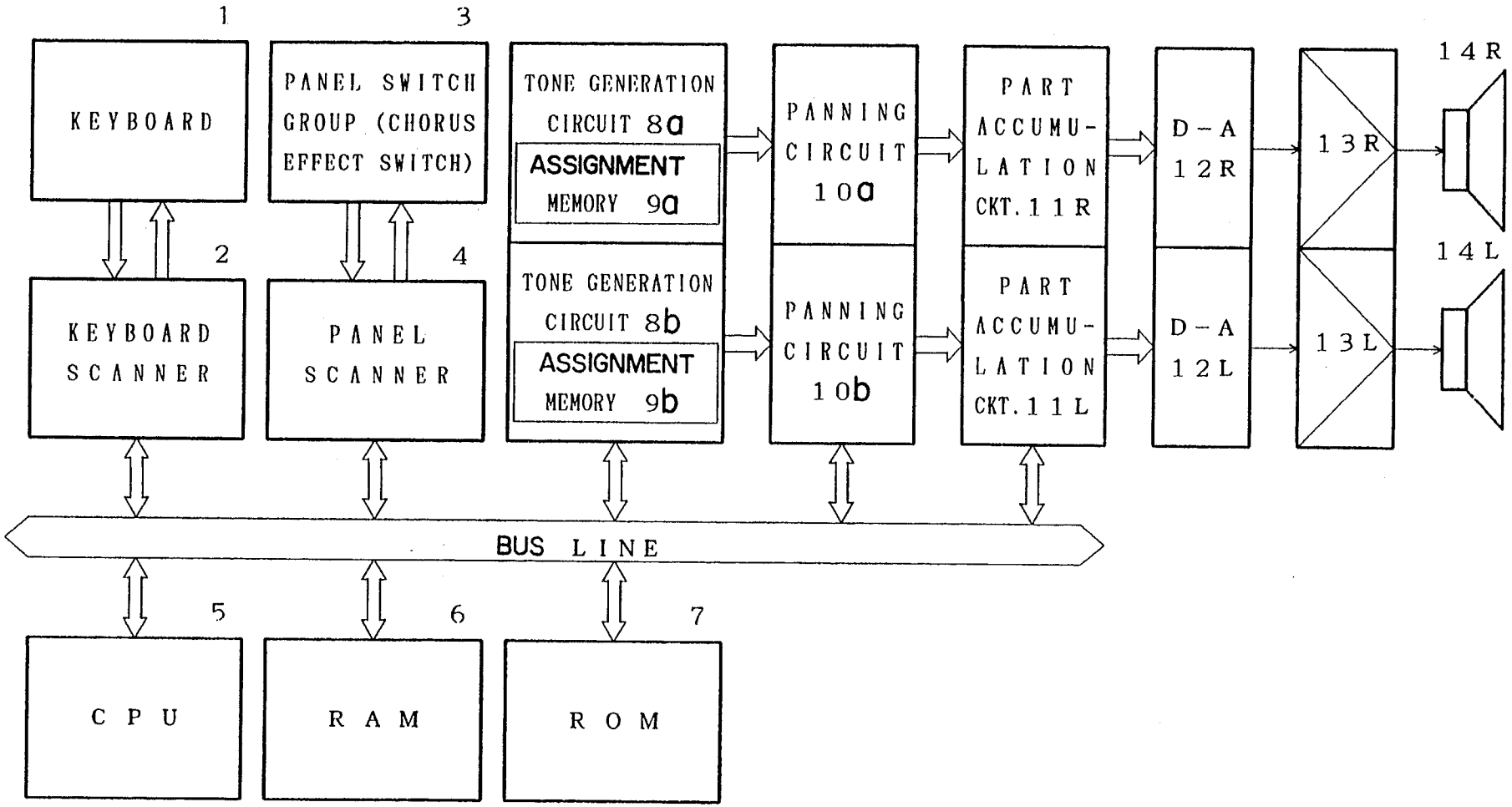
FIG. 6 is a block diagram showing the overall circuit of an electronic musical instrument.

Among tone waveform data generated from tone generators 8*a* and 8*b* of FIG. 6, the sequence of a sounding, sound part or tone color is detected by a CPU 5, as described hereinunder in detail. According to the result of detection, panning data PAN1 and PAN2 for "R3" to "L3" are supplied to panning circuits 10*a* and 10*b* for a stereophonic sound control and according to the sounding sequence (steps 31 to 33, 51, 52, 81), different sound image positions are assigned (steps 34, 36, 38, 40, 53, 56, 59, 62, 65 and 68), or different sound image numbers are assigned (steps 82 and 84). Accordingly, the sound image is varied according to the sound part (such as melody 1, melody 2, and chord). In the case of a drum part, different sound image positions are assigned (step 92) according to the tone color (step 91).

1. Overall circuit

FIG. 6 shows the overall circuit of an electronic musical instrument. A keyboard scan circuit 2 scans the individual keys on a keyboard 1 to detect data indicating a "key-on" and "key-off" state, and this data is written into a RAM 6 by the CPU 5. The data is compared with key state data for individual keys already stored in the RAM 6. The CPU 5 detects "key-on" and "key-off" events for the individual keys. The keyboard 1 may be replaced by an electronic string instrument, an electronic wind instrument, an electronic percussion instrument (pads), or a computer keyboard, etc.

A panel scan circuit 4 scans individual panel switches 3 to detect data indicative of "on" and "off" states of individual switches or indicative of the extent of operation of these switches. The CPU 5 writes the data in the RAM 6 and compares this data with switch state data already stored in the RAM 6, to thereby detect "switch-on" and "switch-off" events. The panel switches 3 include chorus effect switches (not shown) for providing a chorus effect to musical tones to be sounded. The RAM 6 further stores various working data and forms working data registers 21 to be described later. Programs to be executed by the CPU 5, programs for other routines, and auto play data are stored in a ROM 7, as shown by flow charts to be described later. The ROM 7 also serves as a tone color-sound image decoder 20.

Tone generators 8*a* and 8*b* generate tone waveform data according to various tone information provided from the keyboard 1 and panel switches 3, such as pitch (key number) data, tone color (tone number) data, velocity data, volume data, and sound part data PART. Tone waveform data also may be generated according to auto play data read out from the ROM 7 or the RAM 6 or externally input MIDI (musical instrument digital interface) data. The auto play data includes key number data and other data. The two tone generators 8*a* and 8*b* generate respective tone waveform data according to a single "key-on" event, and this data is combined before being output. The paired musical waveform data is the same but may have different tone waveforms or envelope waveforms.

In the tone generators 8*a* and 8*b*, tone generation systems for a plurality of, for example, 16 channels are formed on a time-division basis, for a polyphonic sounding of musical tones. Tone data of musical tones with assigned channels are stored in assignment memories 9*a* and 9*b*, and these assignment memories 9*a* and 9*b* may be formed in the RAM 6. The tone and envelope waveform data are stored in the ROM 7 but may be stored in the tone generators 8*a* and 8*b*.

The individual generated tone waveform data is supplied to panning circuits 10*a* and 10*b* within respective channel times to be made stereophonic, whereby tone waveform data of a right and a left sound source are formed from the input tone waveform data. More specifically, the same tone waveform data and other tone waveform data having a volume level and sounding start moment different from the input tone waveform data are provided with the input tone waveform data. Note, although this embodiment has two tone generators 8*a* and 8*b*, and two panning circuits 10*a* and 10*b*, it is possible to provide three or more circuits or only a single circuit for each.

The pair of tone waveform data for the right and left sound sources is split into right and left sound sources, accumulated for individual sound parts in part accumulators 11R and 11L, converted by D-A (digital-analog) converters 12R and 12L, and then coupled through amplifiers 13R and 13L and loudspeakers 14R and 14L for sounding. The sound image is formed between the two loudspeakers 14R and 14L according to the stereophonic processing thereof in the panning circuits 10*a* and 10*b*.

2. Content of stereo control

Figures 9, 11:
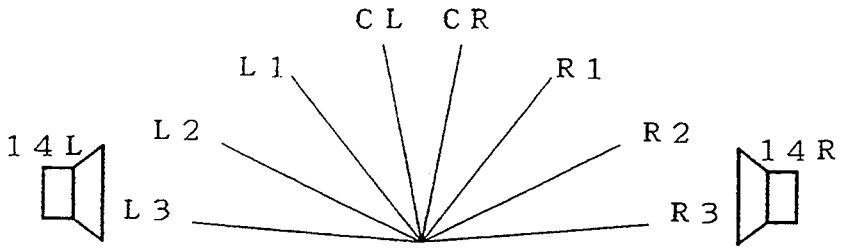
FIG. 9 is a view showing sound image positioning.
FIG. 11 is a view showing the assignment of sound image positions for a drum part, and represents the stored data content in a tone color-sound data decoder 20.

FIGS. 9 to 11 show the content of the stereo control. In this embodiment, eight sound image positions "L3", "L2", "LI","CL", "CR", "R1", "R2" and "R3" are formed as shown in FIG. 9. These sound image positions are realized through the stereophonic processing carried out in the panning circuits 10*a* and 10*b* as noted above.

FIGS. 10A–10D show the positions and number of sound images formed for individual sound parts of "melody, "chord" and "bass". For the melody, the content of the stereo control is different when providing a chorus effect (melody 1) and when not providing a chorus effect (melody 2). Namely, for "melody 1", sound image positions "L1", "R1","CL" and "CR" are assigned sequentially in that order, in correspondence to the sounding order, the sound image position "L1" is assigned again to the fifth tone, and accordingly, the sound image positions "LI", "R1", "CL" and "CR" are sequentially assigned repeatedly.

For "melody 2", the sound image positions "L3" and "R3", "L2" and "R2" and "L1" and "R1" are assigned sequentially and repeatedly in correspondence to the sounding order. In this case, two sound image positions "L3" and "R3", "L2" and "R2", and "L1" and "R1" are formed simultaneously in the respective tone generators 8*a* and 8*b* and panning circuits 10*a* and 10*b*. In the case of "melody 1", the same sound image position is formed through the circuits 8*a*, 8*b*, 10*a* and 10*b*.

The case of "chord" is similar to the case of "melody 2". Namely, in this case, the sound image positions "L3" and "R3", "L2" and "R2" are assigned sequentially and repeatedly in correspondence to the sounding order. For "bass, " the sound image position "CL" is assigned at all times, regardless of the sounding order.

FIG. 11 shows the content of the sound image position assignment for "drum". This content is stored in the tone color-sound image decoder 20. For "drum", sound image positions are assigned in correspondence to the tone color (i.e., tone number). As shown in FIG. 11, "CR" is assigned as the sound image position for the bass drum, "L2" for the closing of the high hat, and "R1" for the cymbal. The method of assigning the positions and number of sound images as noted above is not limitative, and can be variously modified.

3. Panning circuits 10*a* and 10*b*

Figure 7:
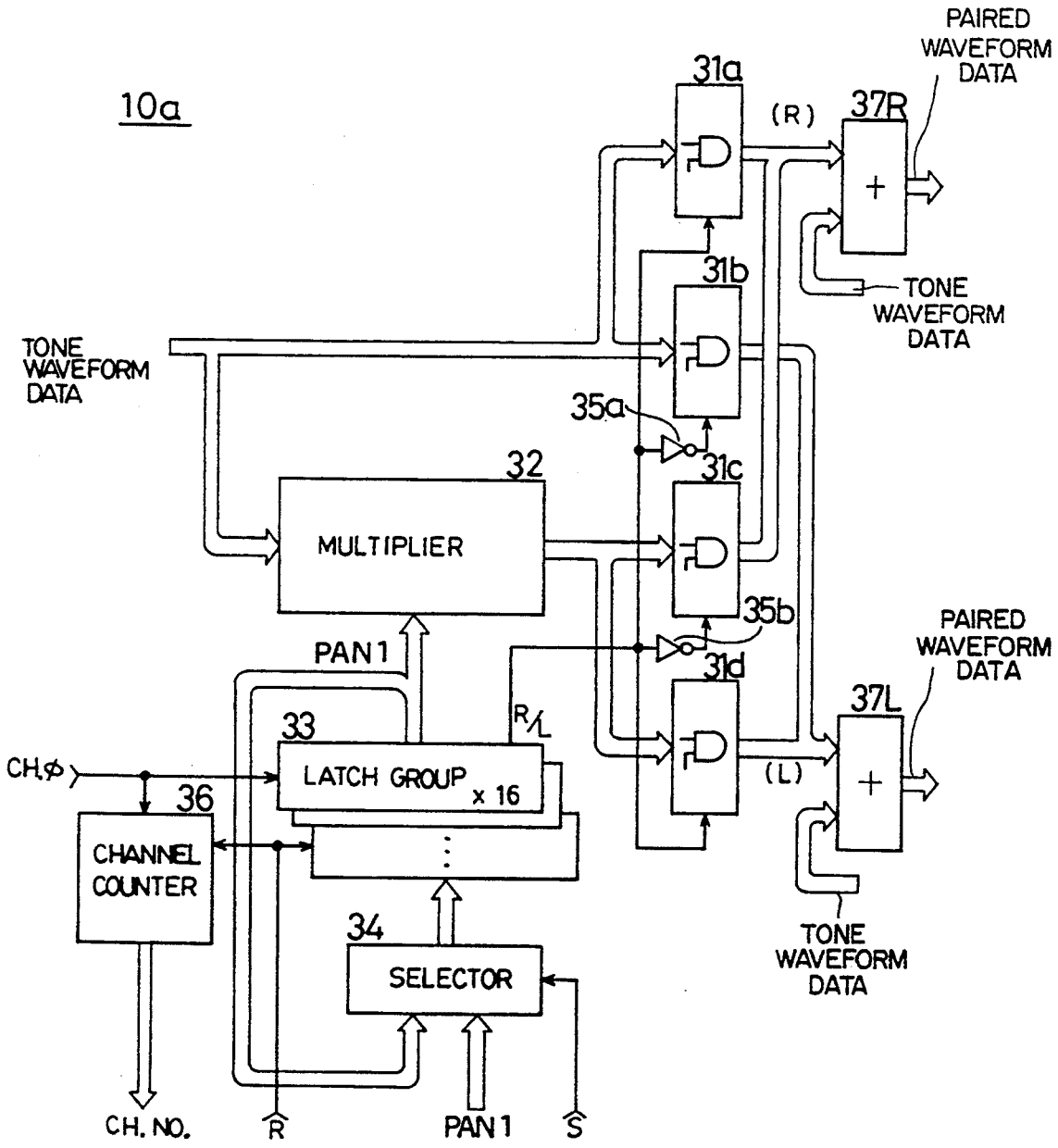
FIG. 7 is a schematic representation of a panning circuit 10*a;*

FIG. 7 shows the panning circuit 10*a*. Note, the panning circuit 10*b* has the same construction as the panning circuit 10*a*. Tone waveform data from the tone generator 8*a* is supplied to a multiplier 32 for multiplication, by panning data PAN1 from a latch group 33, and the product is supplied through an AND gate group 31*c* and an adder 37R to the part accumulator 11R, or is supplied through an AND gate group 31*d* and an adder 37L to the part accumulator 11L. The waveform tone data noted above that is not supplied to the multiplier 32 is supplied through an AND gate group 31*a* and the adder 37R to the part accumulator 11R, or supplied through an AND gate group 31*b* and the adder 37L to the part accumulator 11L. Accordingly, paired waveform tone data for the right and left sound sources are obtained.

The panning data PAN is used for determining the sound image position shown in FIG. 9, to thereby realize a stereophonic sound. The greater the value of the panning data PAN, the more the sound image position is shifted from the center to each side, such as from "CR" to "R1", "R2" and "R3", or from "CL" to "L1", "L2" and "L3". The most significant bit of the right-/left data R/L of the panning data PAN is one-bit data for distinguishing the right sound image positions of "CR" to "R3" ("1") and the left sound image positions of "CL" to "L3" ("0"). Panning data PAN respectively corresponding to these eight sound image positions is stored in the ROM 7, and this data is read out in correspondence to selected sound image positions and set in a first and a second panning register to be described later (steps 34, 36, 38, 40, 53, 56, 59, 62, 65, 68, 76, 82, 84 and 92) and then set in the latch group 33 through a selector 34 (steps 97 and 98).

Panning data PAN1 in the latch group 33 is progressively shifted under the control of a channel clock signal CHϕ, to be fed to the multiplier 32 and to be fed back through the selector 34. Due to the multiplication thereof in the multiplier 32, the sound image position is shifted from the center to the side according to the magnitude of the panning data PAN1. The most significant bit of the right/left data R/L of the panning data PAN1 is fed to the AND gate groups 31*a* and 31*d* directly, and fed to the AND gate groups 31*b* and 31*c* after an inversion thereof through inverters 35*a* and 35*b*. Therefore, when the right/left data R/L is "1" (representing the right side), tone waveform data obtained after multiplication by the panning data PAN1 is fed to the part accumulator 11R to shift the sound image position to the right side, and when the right/left data R/L is "0" (representing the left side), the tone waveform data obtained after multiplication by the panning data PAN1 is fed to the part accumulator 11L to shift the sound image position to the left side.

The channel clock signal CHϕ is supplied to a channel counter 36 to count hexadecimal channel numbers. When the channel number data is identical to the channel number data of tone data already written in the assignment memory 9*a*, the CPU 5 sets the panning data PAN1 in the latch group 33. This channel number data is identical to the sequence of the reading of tone data from individual channel areas of the assignment memory 9*a*, and synchronizes the generation of tone waveform data in individual channels and the multiplication by each panning data PAN, i.e., carries out a stereophonic control.

Figure 12:
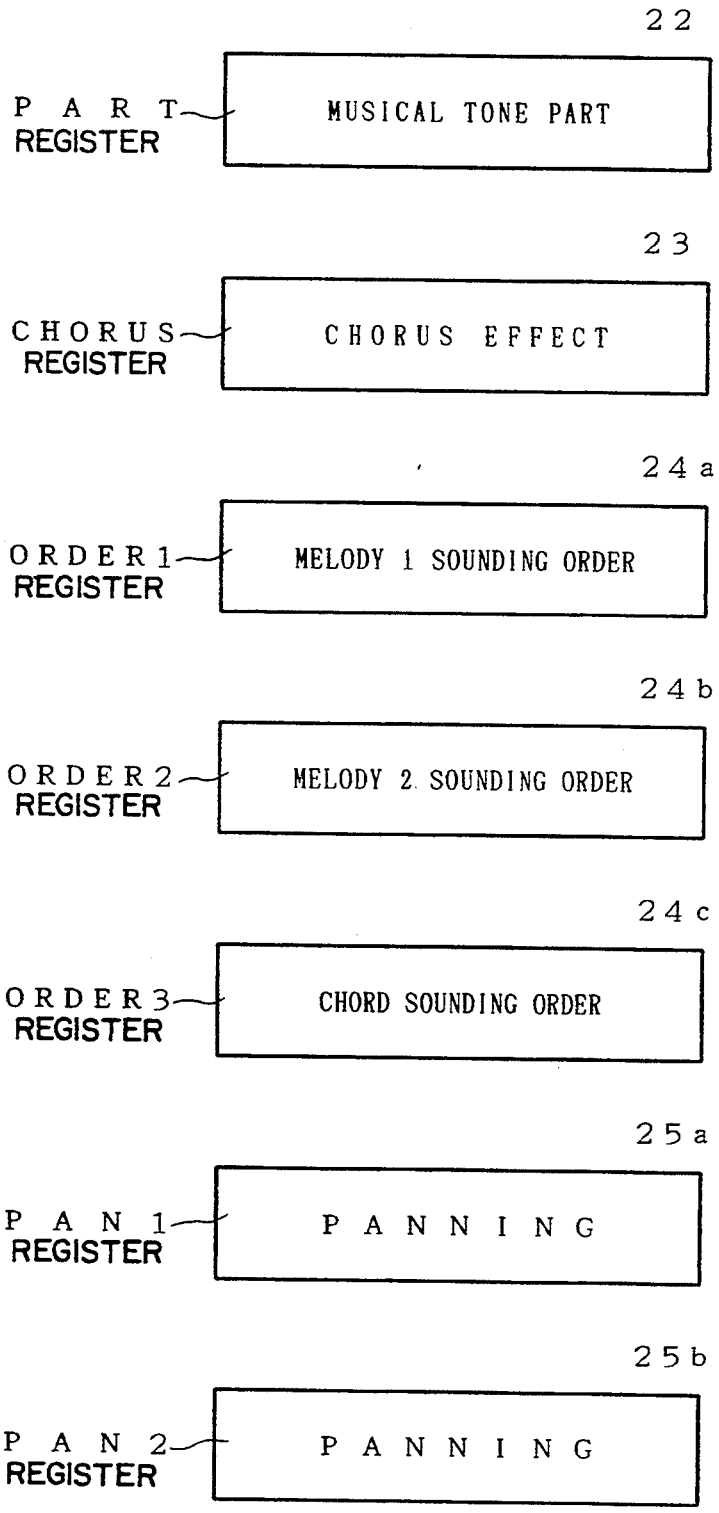
FIG. 12 is a view showing working registers 21 in a RAM 6.

When setting the panning data PAN1, the CPU 5 provides a set signal S to the selector 34, to switch select data to the panning data PAN1 from the first panning register 25*a*, as illustrated in FIG. 12. The latch group 33 and channel counter 36 are cleared by a reset signal R from the CPU 5, and the right and left sound source tone waveform data from the other panning circuit 10*b* are fed to the adders 37R and 37L and combined.

It is possible that with a lowering of the value of the panning data PAN, the sound image position is shifted from "CR" to "R1" to "R3" or from "CL" to "L1" to "L3". As a further alternative, the right/left data R/L may have a converse characteristic. Further, the multiplier 32 may be replaced with a level shifter on any other circuit, as long as the level of the tone waveform data can be varied.

Figure 8:
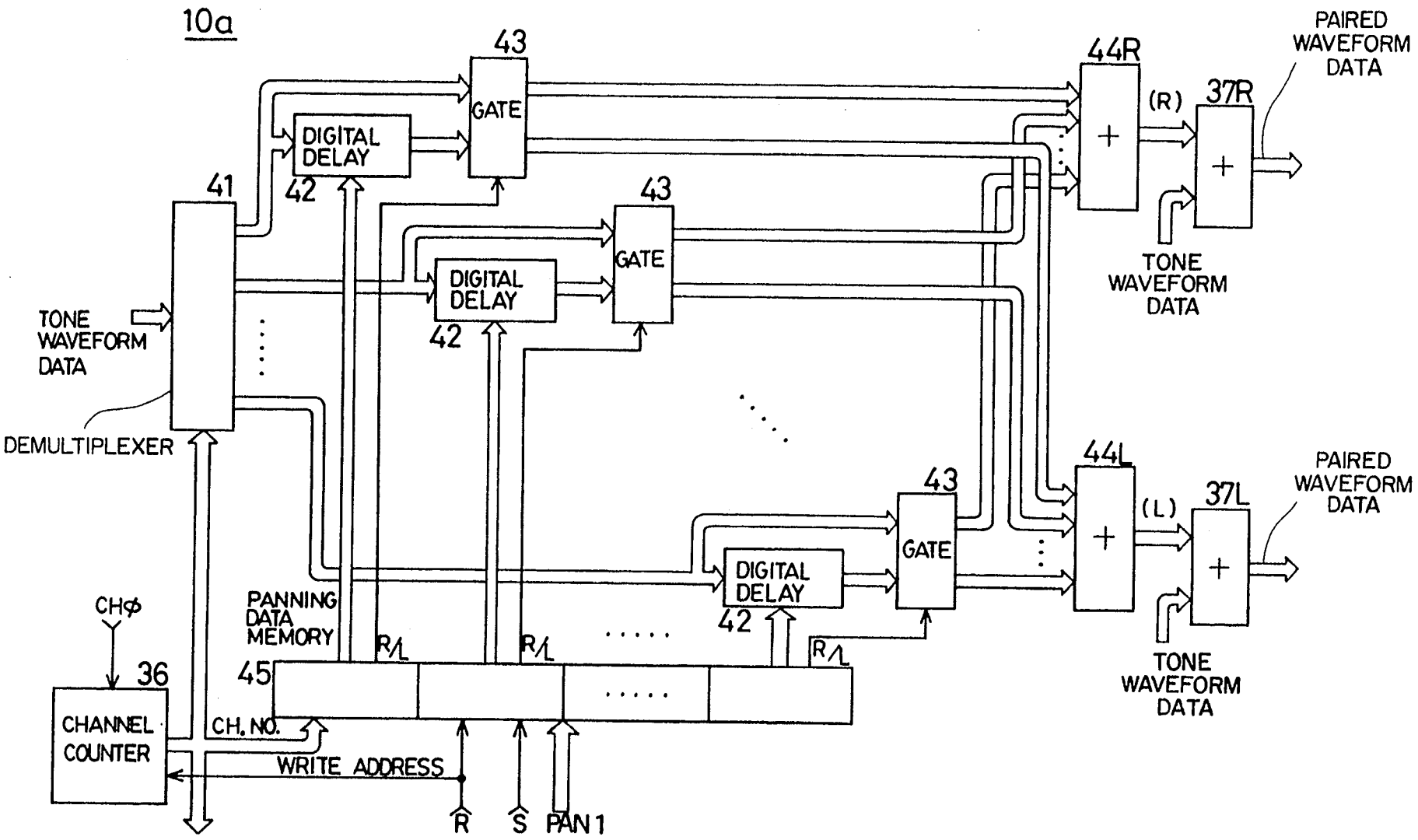
FIG. 8 is a schematic representation of another panning circuit 10*b;*

FIG. 8 shows a different example of the panning circuit 10*a*. Note, the panning circuit 10*b* has the same construction as the panning circuit 10*a*. The circuit shown in FIG. 8 effects a stereophonic control by controlling the moment of the start of a sounding, instead of the volume level, of the right or left sound source. This circuit may be replaced with circuits disclosed in U.S. patent application Ser. No. 07/813,933.

Tone waveform data from the tone generator 8*a* is fed to a demultiplexer 41, and demultiplexed for individual channel moments. The demultiplexed data is fed to 16 respective gate circuits 43 directly and through respective digital delay circuits 42. The gate circuits 43 provide the same effect as that of the AND gate groups 31*a* to 31*d* and inverters 35*a* to 35*b*, and provide tone waveform data for the right and left sound sources, this data being added in adders 44R and 44L to be fed through adders 37R and 37L to the part accumulators 11R and 11L. The digital delay circuits 42 are each constituted by a CCD (charge coupled device) or a BBD (backer bridge device) and provide a delay time corresponding to given delay data.

The panning circuit further includes a panning data memory 45 having 16 addresses; individual panning data PAN1 being written in the respective addresses. The write address is designated by the channel number data from the channel counter 36, and a write command signal is the set signal S from the CPU 5. The channel number data is also provided from the demultiplexer 41. The individual panning data PAN1 written in the panning data memory 45 is also supplied to the digital delay circuits 42, to provide a delay for delay times corresponding to the magnitude of the value of the panning data PAN1. The most significant bit of the right/left data R/L of the panning data PAN1 is provided to the gate circuits 43.

The panning circuits 10*a* and 10*b* noted above may be constituted as a single or an integral circuit. This may be done by providing 32 stages as the latch group 33, 32 digital delay circuits 42 and gate circuits 43 and 32 as addresses of the panning data memory 45. Further, a pair of panning data PAN1 and PAN2 is set consecutively in the latch group 33 or panning data memory 45. In this case, it is possible to provide the tone generator 8*a* (8*b*) and assignment memory 9*a* (9*b*) as an integral circuit, for processing 32 channels on a time-division basis.

Further, the digital delay circuits 42 in FIG. 8 may be replaced with the multiplier 32 shown in FIG. 7. Furthermore, it is possible to locate the multiplier 32 shown in FIG. 7 adjacent to each digital delay circuit 42, to effect a control of the sounding moment and a control of the volume level at the same time. Also, the panning circuits 10*a* and 10*b* may be realized as analog circuits of any circuits, as long as a stereophonic control can be obtained.

Further, it is possible to construct the assignment memories 9*a* and 9*b* and panning circuits 10R and 10L in such a manner that a one-to-one correspondence between the 16 channels No. 0 to No. 15 and the sound image positions "R3", "R2", "R1", "CR", "CL", "L1", "L2," and "L3" is provided. In this case, the panning data PAN1 (PAN2) set in the latch group 33 in FIG. 7 and the panning data memory 45 in FIG. 8 are fixed in manner in the sequence "R3", "R2", "R1", "CR", "CL", "L1", "L2" and "L3" the CPU 5 does not change the sequence of the panning data PAN1 (PAN2). The sound image position "R3" is given to tones with channels No. 0 and No. 1 assigned thereto, "R2" is given to tones with channels No. 2 and No. 3 assigned thereto, "R1" is given to tones with channels No. 4 and No. 5 assigned thereto, and so forth. Channel areas of the assignment memories 9*a* and 9*b*, in which sounding tone data is written, are determined according to the values of the panning data PAN1 (PAN2). The channel assignment is effected according to the values of the panning data PAN1 (PAN2), in steps 96 to 98 of a single tone sounding routine to be described later. It is possible to provide four or more panning circuits 10R and 10L with a reduced number of channels.

4. Working register group 21

FIG. 12 shows a working register group 21. The working register group 21 includes a sound part register (PART) 22, a chorus effect register (CHORUS) 23, a melody 1 sounding order register (ORDER1) 24*a*, a melody 2 sounding order register (ORDER2) 24*b*, a chord sounding order register (ORDER3), a first panning register (PAN1) 25*a* and a second panning register (PAN2) 25*b*.

Sound part data PART is set in the sound part register 22, and indicates that a tone pertaining to a sounding or muting event is for melody ("01"), chord "10", bass (11") or drum ("00"). Chorus effect data CHORUS is set in the chorus effect register 23, and indicates that a chorus effect pertaining to a chorus effect switch (not shown) in the panel switch group 3 is "on" ("1") or "off" ("0").

"Melody 1" sounding order data ORDER1 is set in the melody 1 sounding order register 24*a*, and is incremented for every "on" event such as from an initial "0-th" to "1-th", "2-nd" and "3-rd" and then back to "0-th", i.e., is subject to a repeated ring counting of "0" to "3". "Melody 2" sounding order data ORDER2 is set in the melody 2 sounding order register 24*b*, and is incremented for every "on" event such as from an initial "0-th" to "1-st" and "2-nd" and then back to "0-th", i.e., is subject to a repeated ring counting of "0" to "2".

The "melody 1" and "melody 2" are discriminated from each other in accordance with whether the chorus effect is "on" or "off". "Chord" sounding order data ORDER3 is set in the chord sounding order register 24*c*, and is incremented for every "on" event such as from an initial "0th" to "1-st" and then back to "0-th", i.e., is subject to a repeated ring counting of "0" to "1". The positions and number of sound images are controlled according to the sounding order chord.

Panning data PAN1 transferred to the panning circuit 10*a* is set in the first panning register 25*a*, and panning data PAN2 transferred to the panning circuit 10*b* is set in the second panning register 25*b*. The panning data PAN1 and PAN2 indicate the sound image positions "L3" to "R3" shown in FIG. 9, and an increase of the value of the panning data PAN causes the sound image position to be shifted from the center "CL" or "CR" toward the side "L3" or "R3". The most significant bit of the panning data PAN is right/left data indicating the right side "CR" to "R3" ("1") or the left side "CL" to "L3" ("0") with regard to the sound image position.

5. Main routine

Figure 13:
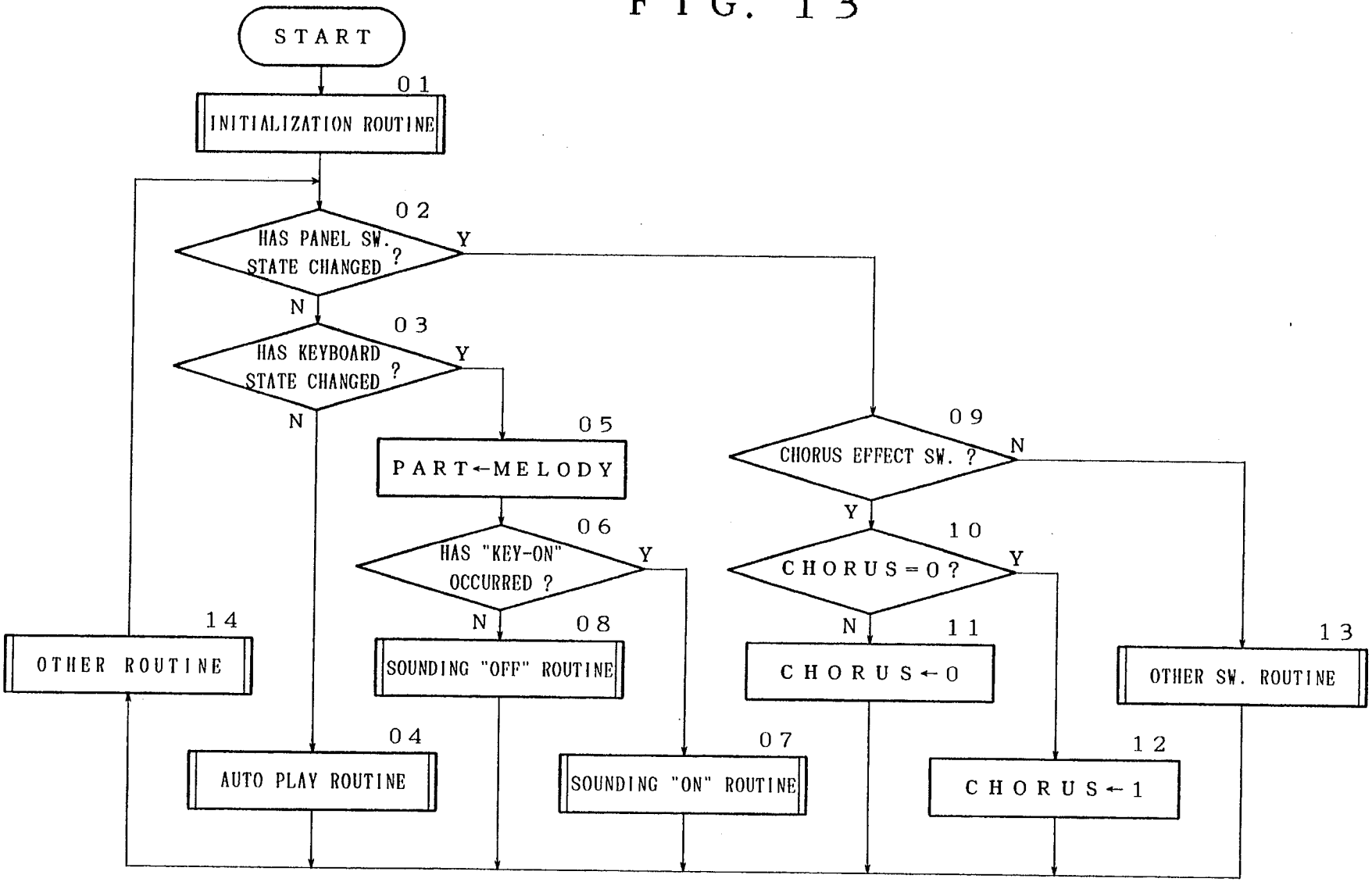
FIG. 13 is a flow chart of a main routine.

FIG. 13 is a flow chart showing a main routine executed by the CPU 5. This routine is started by switching on the power supply. In this routine, an initialization is first executed (step 01), the panel switches 3 are then scanned to determine any change in the state thereof (step 02), and the keyboard 1 is also scanned to determine any change in the state thereof (step 03). If no change is detected in these steps, an auto play routine is executed (step 04).

If a change in the state of the keyboard 1 is detected, "melody" sound part data PART is set in the sound part register 22 in the working register group 21 of the RAM 6 (step 05). If the change is a "key-on" change (step 06), a sound "on" routine is executed (step 07), and if the change is not a "key-on" change (step 06), a sound "off" routine is executed (step 08). Accordingly, a sound is made "on" and "off" according to "key-on" and "key-off" events.

If a change of the state of the panel switch group 3 is detected in step 02, it is determined whether this state change is at a chorus effect switch (step 09), and if so, the value of THE CHORUS EFFECT DATA CHORUS in the chorus effect register 23 of the working register group 21 is determined (step 10). If the value is "1", it is changed to "0" (step 11), and if the value is "0", it is changed to "1" (step 12). The chorus effect switch is made on or off according to the result of this check. If it is found in step 09 that the change is not a chorus effect switch state change, a routine for an other switch is executed (step 13), and various other routines are executed (14). The main routine then returns to step 02.

6. Sound "on" routine

Figure 14:
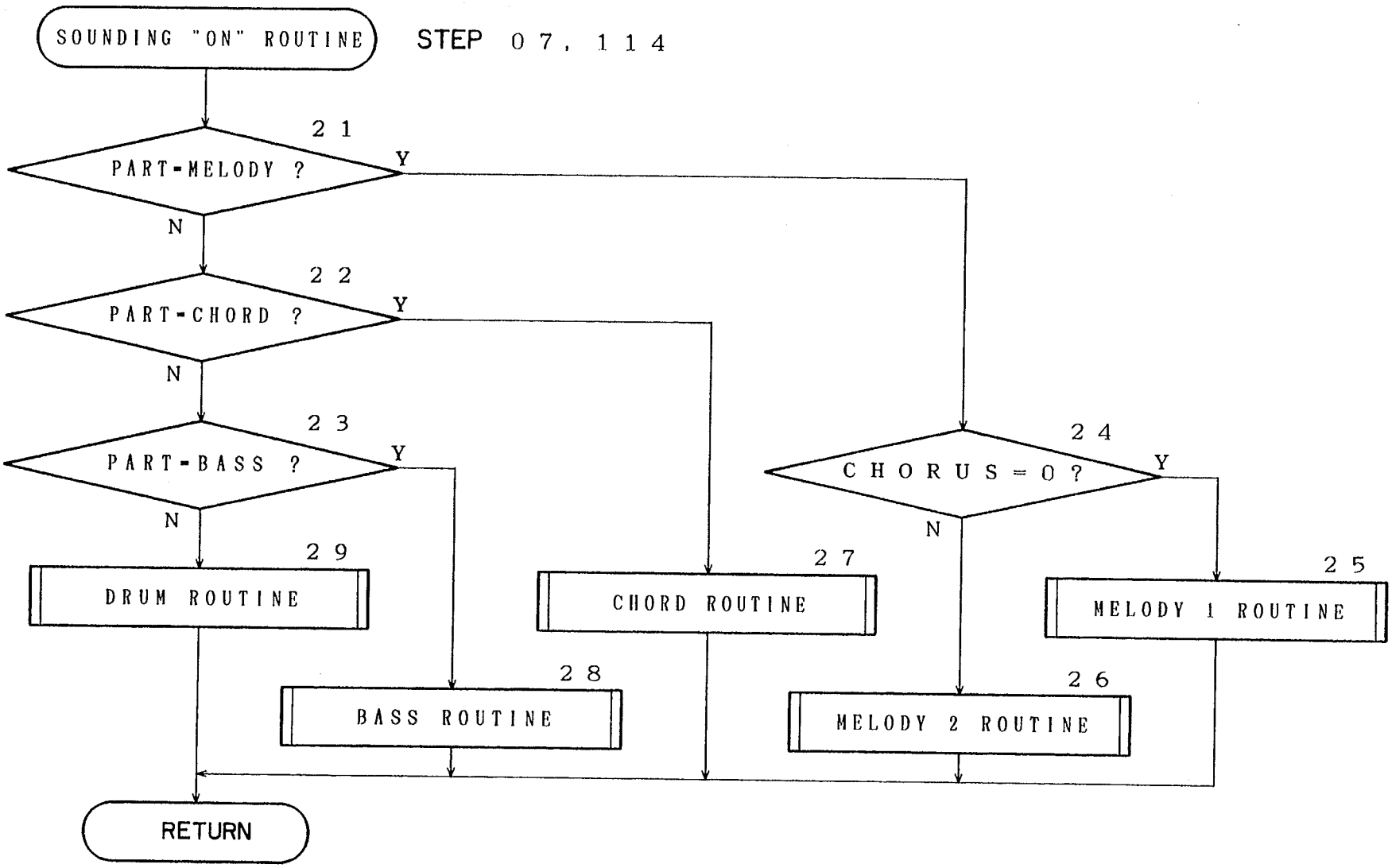
FIG. 14 is a flow chart of a sounding routine.

FIG. 14 is a flow chart showing the sound "on" routine in step 07. In this routine, it is determined whether the sound part data PART set in the part register 22 is for "melody", "chord" or "bass" (steps 21, 22 and 23). If the data is found to be for "melody", a melody 1 routine is executed (step 24) if the value of the chorus effect data CHORUS in the chorus effect register 23 is "0" (step 24), and a melody 2 routine is executed (step 26) if that value is "1".

If it is found in step 22 that the data is for "chord", a chord routine is executed (step 27), and if it is found in step 23 that the data is for "bass", a bass routine is executed (step 28). Further, if it is found in steps 21 through 24 that the data is not for "melody", "chord" or "bass", a drum routine is executed (step 29). Accordingly, a sounding is effected for each of the sound parts of "melody", "chord" and "bass". In the sound "on" routine (steps 25 through 29), different positions or numbers of sound images are assigned for different sound parts, for a stereophonic control according to the sound part.

The sound part data PART set in the part register 22 is for "melody" when the keyboard 1 is operated, and in the auto play to be described later is for "melody", "chord" or "bass" or is cleared. Note, the sound part data PART may be for "chord", "bass", etc., when the keyboard 1 is operated by a mode switching or is determined according to an externally input MIDI.

7. Melody 1 routine

Figure 1:
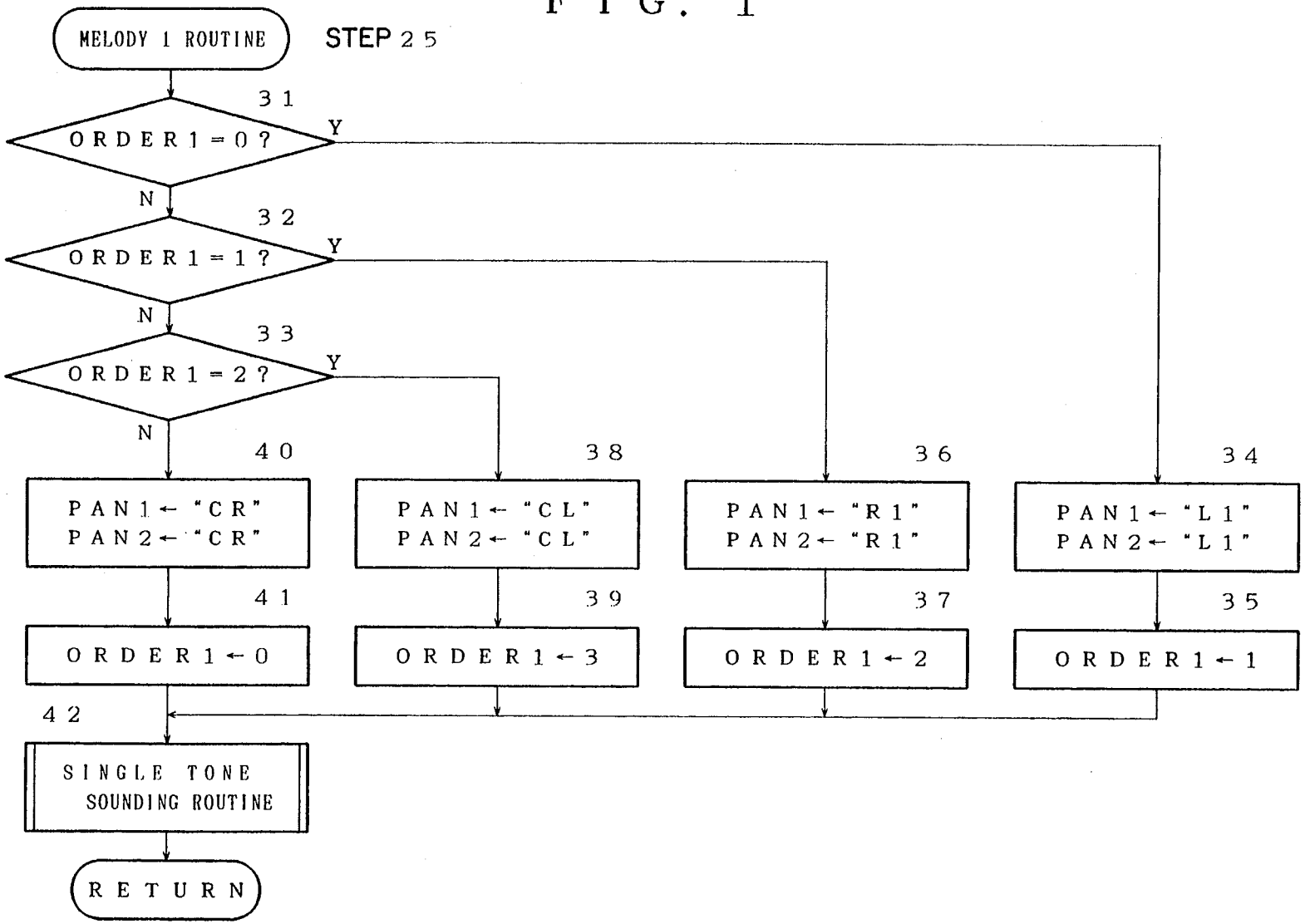
FIG. 1 is a flow chart of a melody 1 routine.

FIG. 1 is a flow chart showing the melody 1 routine in step 25. In this routine, it is determined whether the sounding order data ORDER1 set in the melody 1 sounding order register 24*a* represents "0" (0-th), "1" (1-st) or "2" (2-nd), i.e., the sounding order of the melody sounding part is detected (steps 31 to 33). If the data is "0", the panning data PAN1 and PAN2 for the sound image position "L1" are set in the respective first and second panning registers 25*a* and 25*b*, to assign the sound image position "L1" (step 34), the sounding order data ORDER1 in the melody 1 sounding order register 24*a* is changed from "0" to "1" (step 35), and a single tone sounding routine is executed (step 42).

If it is found in step 32 that the sounding order ORDER1 is "1", the panning data PAN1 and PAN2 for the sound image position "R1" are set in the first and second panning registers 25*a* and 25*b*, to assign the sound image position "R1" (step 36), the sounding order data ORDER1 in the melody 1 sounding order register 24*a* is changed from "1" to "2" (step 37, and the single tone sounding routine is executed (step 42).

If it is found in step 33 that the sounding order data ORDER1 is "2", the panning data PAN1 and PAN2 for the sound image position "CL" are set in the first and second panning registers 25*a* and 25*b*, to assign the sound image position "CL" (step 38). the sounding order data ORDER1 in the melody sounding order register 24*a* is changed from "2" to "3" (step 39). and the single tone sounding routine is executed (step 42).

If it is found in step 33 that the sounding order data ORDER1 is "3", the panning data PAN1 and PAN2 for the sound image position "CR" are set in the first and second panning registers 25*a* and 25*b*, to assign the sound image position "CR" (step 40), the sounding order data ORDER1 in the melody 1 sounding order register 24*a* is changed from "3" to "0" (step 41). and the single tone sounding routine is executed (step 42). Accordingly, different sound image positions are assigned according to the sounding order data ORDER1, and a stereophonic control is effected according to the sounding order.

8. Melody 2 routine

Figure 2:
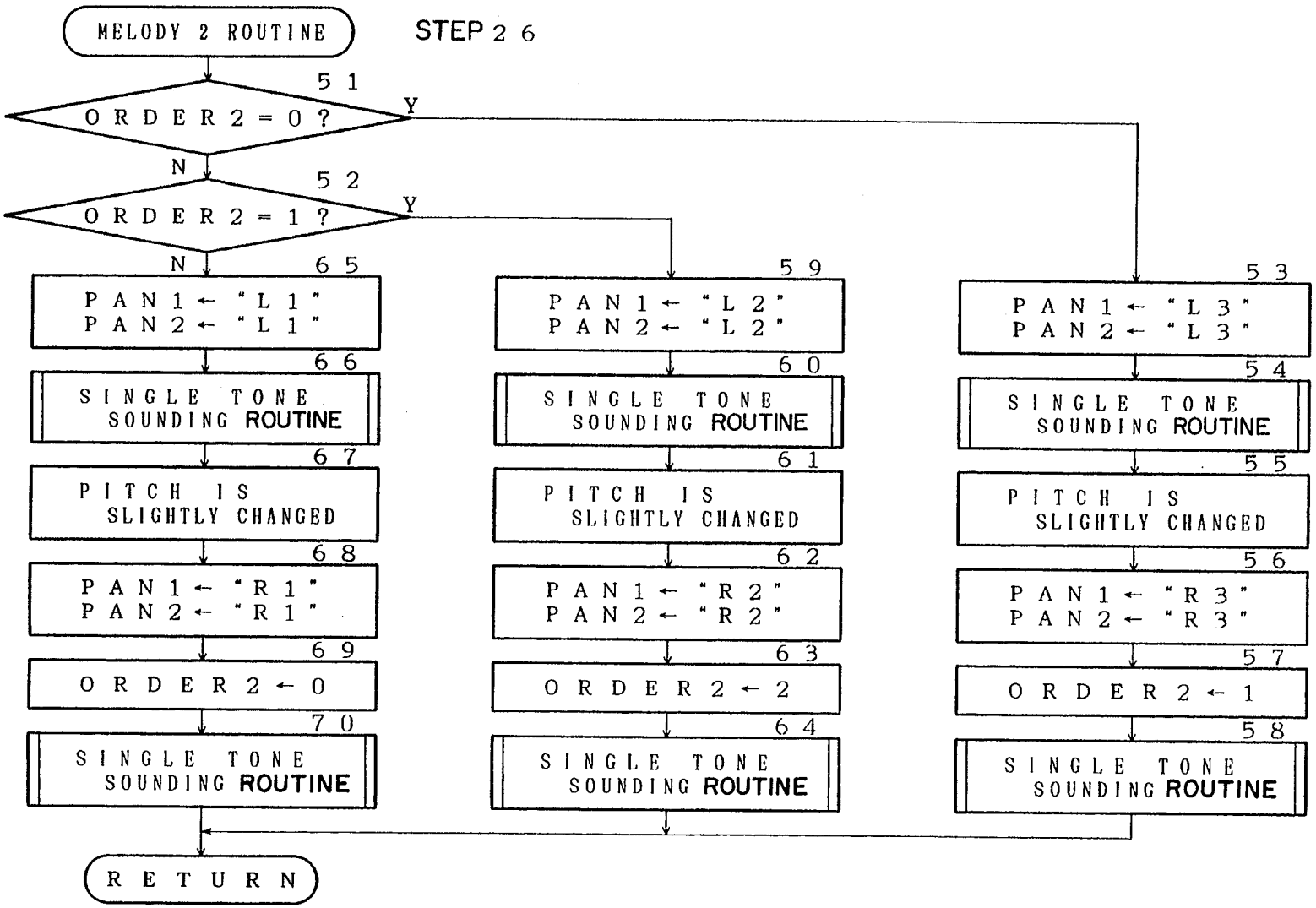
FIG. 2 is a flow chart of a melody 2 routine.

FIG. 2 is a flow chart showing the melody 2 routine in step 26. In this routine, it is determined whether the sounding order data ORDER2 set in the melody sounding order register 24*b* represents "0" (0-th) or "1" (1-st), i.e.. the sounding order of the melody sounding part is detected (steps 51 and 52). If the data is "0", the panning data PAN1 and PAN2 for the sound image position "L3" are set in the first and second panning registers 25*a* and 25*b*, to assign the sound image position "L3" (step 53), and a single tone sounding routine is executed (step 54). Also, the pitch of the "on-key" detected in step 03 is slightly changed (step 55), whereby a fixed value is added to or subtracted from a key or frequency number data set in the assignment memories 9*a* and 9*b* of the tone generators 8*a* and 8*b*, in step 58 to be described later.

Then, the panning data PAN1 and PAN2 for the sound image position "R3" are set in the first and second panning registers 25*a* and 25*b*, to assign the sounding image position "R3" (step 56), the sounding order data ORDER2 in the melody 2 sounding order register 24*b* is changed from "0" to "1" (step 57), and a single tone sounding routine is executed (step 58). Accordingly, a tone having a slightly deviated pitch is sounded as two sound images, to thereby realize a chorus effect. This is the same in steps 59 to 64 and 65 to 70 to be described later.

If it is found in step 52 that the sounding sequence data ORDER2 is "1" (1-st), the panning data PAN1 and PAN2 are set in the first and second panning registers 25*a* and 25*b* to assign the sound image position "L2" (step 59), and a single tone sounding routine is executed (step 60). Then, as in step 55, the pitch is slightly changed (step 61), the panning data PAN1 and PAN2 for the sound image position "R2" are set in the first and second panning registers 25*a* and 25*b*, to assign the sound image position "R2" (step 62), and further, the sounding order data ORDER2 in the melody 2 sounding order register 24*b* is changed from "1" to "2" (step 63), and a single tone sounding routine is executed (step 64).

If it is found in step 52 that the sounding order data ORDER2 is "2", the panning data PAN1 and PAN2 for the sound image position "LI" are set in the first and second panning data registers 25*a* and 25*b*, to assign the sound image position "L1" (step 65), and a single tone sounding routine is executed (step 66). Then, as in step 55, the pitch is slightly changed (step 67), and the panning data PAN1 and PAN2 for the sound image position "R1" are set in the first and second panning registers 25*a* and 25*b*, to assign the sound image position "R1" (step 68), and further the sounding order data ORDER2 in the melody 2 sounding order register 24*b* is changed from "2" to "0" (step 69), and a single tone sounding routine is executed (step 70).

Accordingly, as described above, different sound image positions are assigned according to the sounding order data ORDER2 for a stereophonic control according to the sounding order. The melody 2 routine is executed when a chorus effect is to be provided, but the melody 1 routine is executed when no chorus effect is to be provided. Different sound image positions are assigned according to the chorus effect data CHORUS for a stereophonic control, according to the effect content. In addition to the chorus effect, it is possible to carry out a stereophonic control according to the "on" and "off" of various effects such as glide, portamento, vibrato, tremolo, growl, mandolin, reverb, feather, celesta and sustain.

9. Chord routine

Figure 3:
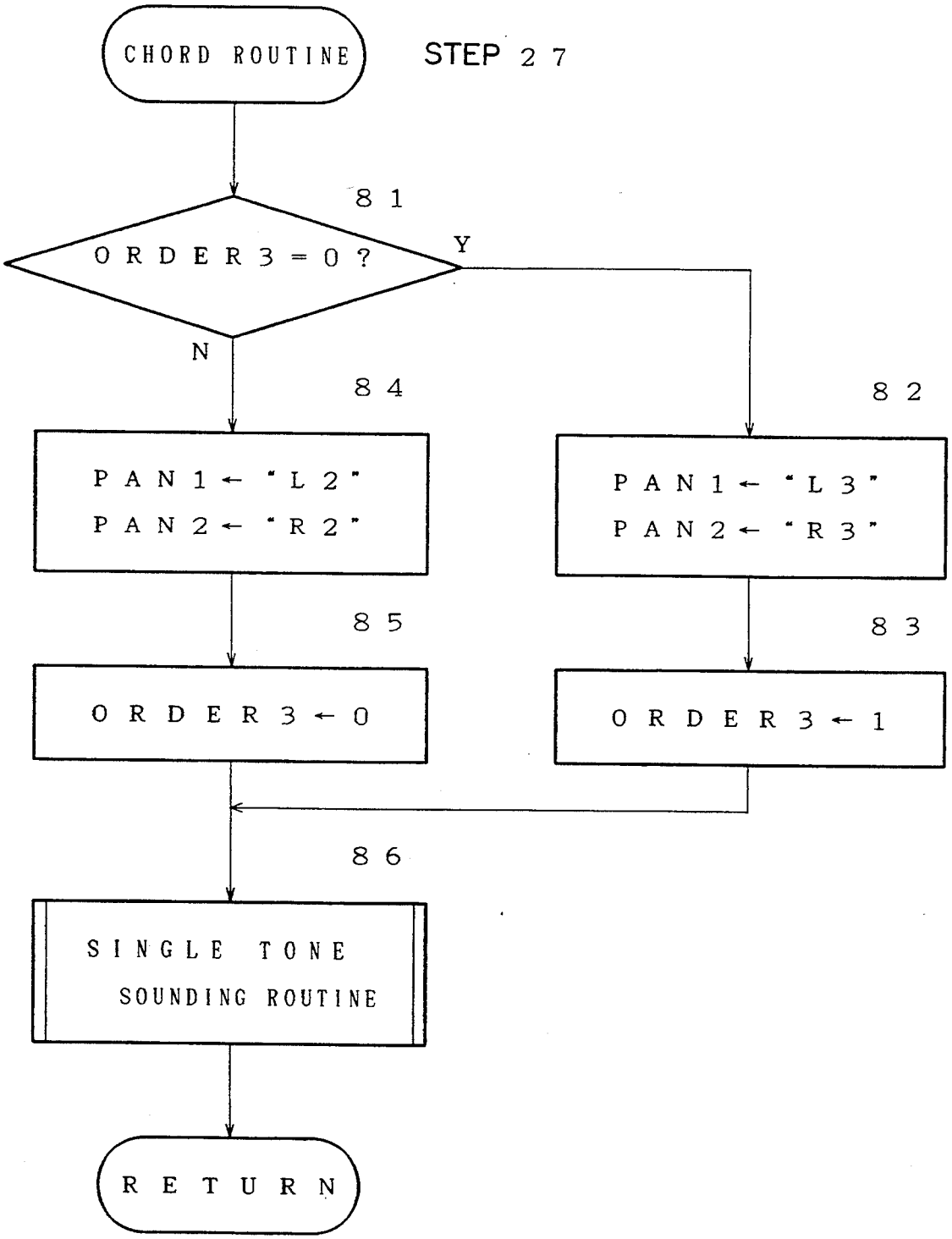
FIG. 3 is a flow chart of a chord routine.

FIG. 3 is a flow chart showing a chord routine in step 27. In this routine, it is determined whether the sounding order data ORDER3 set in the chord sounding order register 24*c* is "0" (0-th), i.e., the sounding order of the chord sound part is detected (step 81). If the data is "0", the panning data PAN1 for the sound image position "L3" is set in the first panning register 25*a*, to assign the sound image position "L3" and the panning data PAN2 for the sound image position "R3" is set in the second panning register 25*b*, to assign the sound image position "R3" (step 82), the sounding order data ORDER3 in the chord sounding order register 24*c* is changed from "0" to "1" (step 83), and a single tone sounding routine is executed (step 86).

If it is found in step 81 that the sounding order data ORDER3 is "1", the panning data PAN1 for the sound image position "L2" is set in the first panning register 25*a* to assign the sound image position "L2" and the panning data PAN2 for the sound image position "R2" is set in the second panning data register 25*b*, to assign the sound image position "R2" (step 84), the sounding order data ORDER3 in the chord sounding order register 24*c* is changed from "1" to "0", and a single tone sounding routine is executed (step 86).

Therefore, different sound image positions are assigned according to the sounding order data ORDER3 for a stereophonic Control in accordance with the sounding order. In steps 82 and 84 of this chord routine, two sound images are produced, sound image number is varied in accordance with the chord sounding, and the stereophonic control is effected in correspondence to the sound part. To vary the sound image number according to the sounding order, steps 34, 36, 38, 40, 53, 56, 62, 65 and 68 are partly replaced with steps 82 and 84.

10. Bass routine

Figure 4:
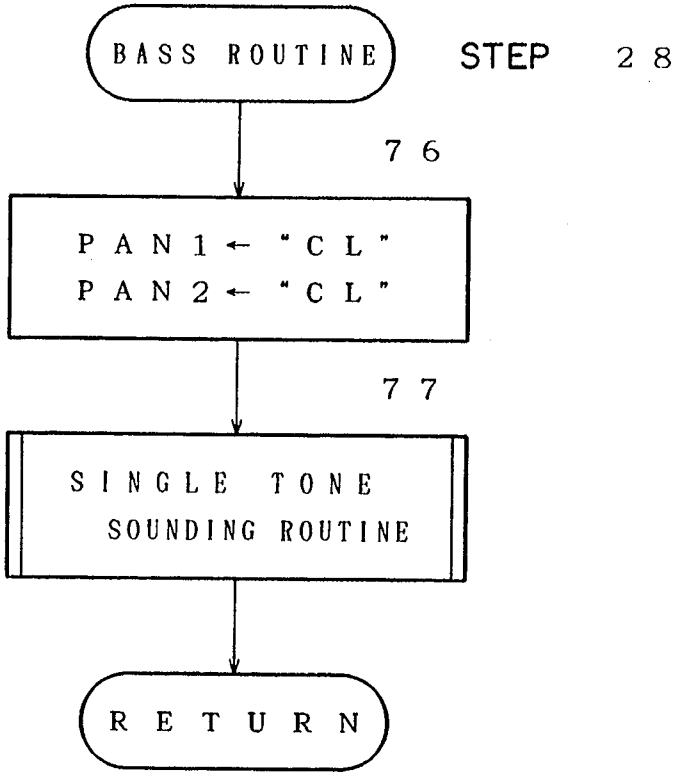
FIG. 4 is a flow chart of a bass routine.

FIG. 4 is a flow chart showing a bass routine in step 28. In this routine, the panning data PAN1 and PAN2 are set in the first and second panning registers 25*a* and 25*b* to assign the sound image position "CL" (step 76), and a single tone sounding routine is executed (step 77). Namely, for a bass tone, the sound image position "CL" is assigned at all times. Note, it is possible to vary the positions and number of sound images according to the sounding order or sound part, as in the above melody 1, melody 2, and chord routines.

11. Drum routine

Figure 5:
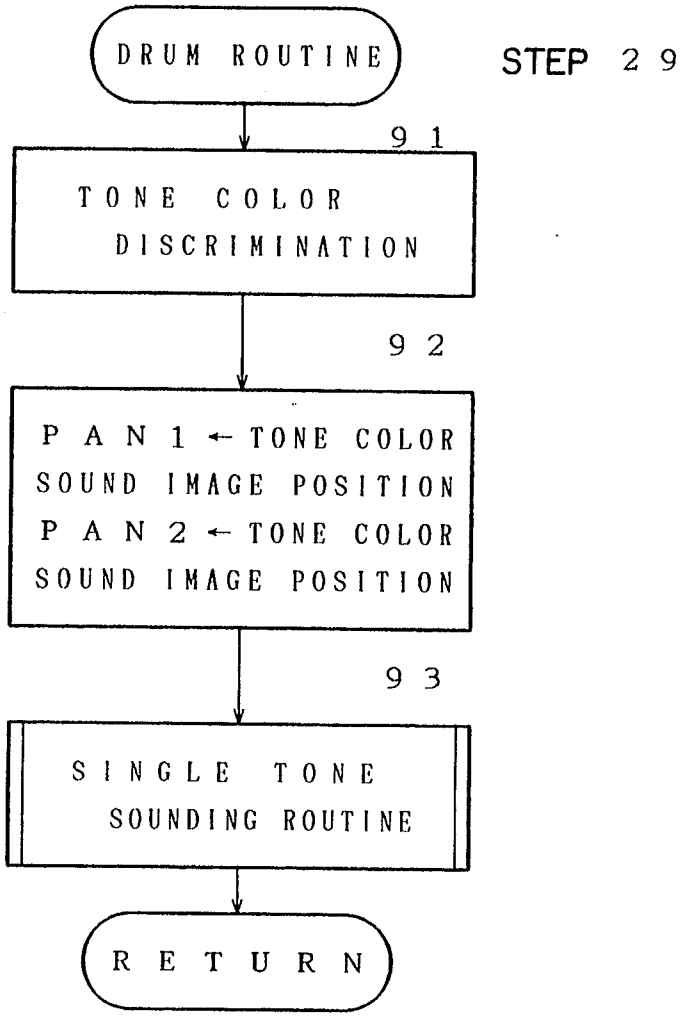
FIG. 5 is a flow chart of a drum routine.

FIG. 5 is a flow chart showing a drum routine in step 29. In this routine, according to each tone color (or tone number) drum data, panning data PAN is correspondingly read out from the tone color-sound image decoder 20 shown in FIG. 11 (step 91), the read-out panning data PAN being set in the first and second panning data registers 25*a* and 25*b* to assign the sound image position (step 92), and a single tone sounding routine is executed (step 93).

Accordingly, different sound image positions are assigned according to the tone number data of the bass drum, closing of the high hat, etc., as shown in FIG. 11, for a stereophonic control according to the tone color. The tone color-sound image decoder 20 shown in FIG. 11 may further store panning data PAN corresponding to the tone colors of piano, violin, and flute, etc., and the routine of the steps 91 to 93 can be executed for melody, chord, and bass, etc. Further, the tone color (tone number) data may correspond to the waveform (for example, sinusoidal, triangular, rectangular, organ type envelope, and percus type envelope), to specific spectrum rates (for example, harmonic rate or noise rate), to a plurality of frequency components of spectral groups in specific frequency bands for respective specific formats, and to waveforms from the start to the end of a sounding. Further, the positions and number of sound images controlled in the above various routines are not limited to those noted above; for example, it is possible to provide more or less than eight sound image positions and three or more sound images.

12. Single tone sounding routine

Figure 15:
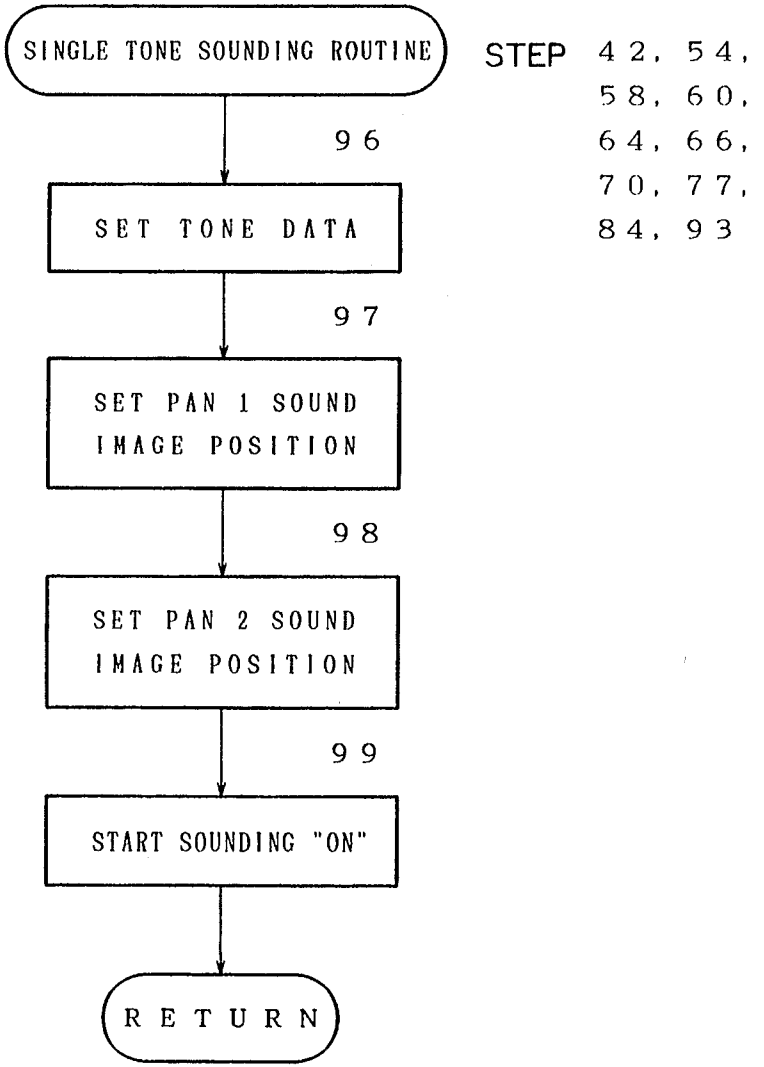
FIG. 15 is a flow chart of a single tone sounding routine.

FIG. 15 is a flow chart showing the single tone sounding routine in steps 42, 54, 58, 60, 64, 66, 70, 86, 77, 93, etc. In this routine, tone data representing the key number, volume, tone number and sound part of musical tones to be sounded is written in empty channel areas of the assignment memories 9*a* and 9*b* of the tone generators 8*a* and 8*b* (step 96). The written data corresponds to the content of the operation of the keyboard 1 or the panel switch group 3 or to the content of the auto play data read from the ROM 7. The panning data PAN1 in the first panning register 25*a* is set in the corresponding channel stage in the latch group 33 of the panning circuit 10*a* (step 97), and the panning data PAN2 in the second panning register 25*b* is set in the corresponding channel stage in the latch group of the panning circuit 10*b* (step 98). Further, the "on/off" data in the written channel area of the assignment memory is made "1" ("on" state), to thereby turn the sounding "on" (step 99).

13. Initialization routine

Figure 16:
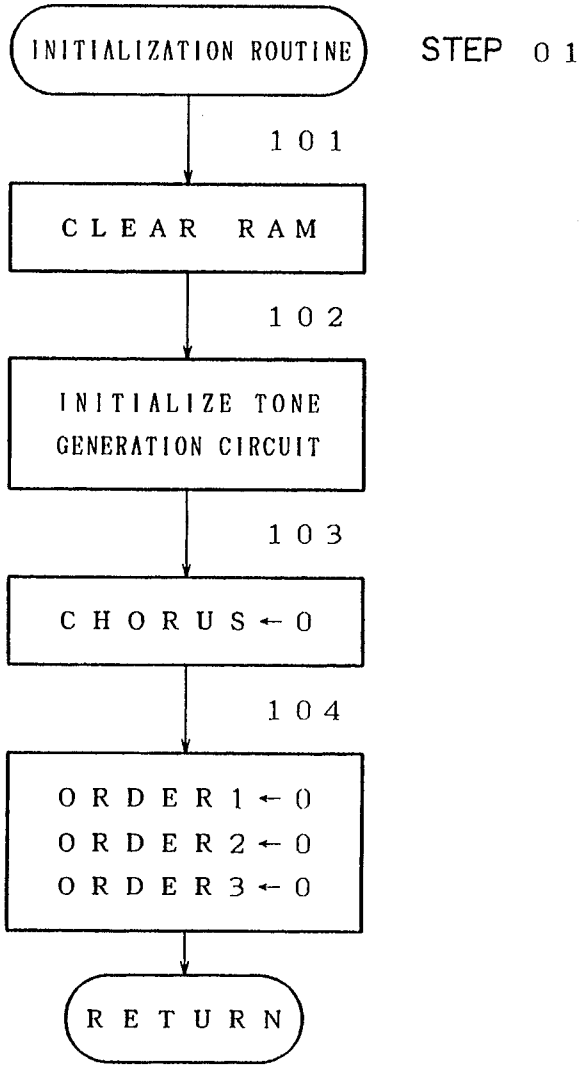
FIG. 16 is a flow chart of an initializing routine.

FIG. 16 is a flow chart showing the initialization routine in step 01. In this routine, the RAM 6 is entirely cleared (step 101), and all the channel areas of the assignment memories 9*a* and 9*b* of the tone generators 8*a* and 8*b* are cleared and initialized (step 102). Then, all of the working registers 21 are cleared (step 103), and further, the melody 1 sounding order register 24*a*, melody 2 sounding order register 24*b*, and chord sounding order register 24*c* are cleared (step 104).

14. Auto play routine

Figure 17:
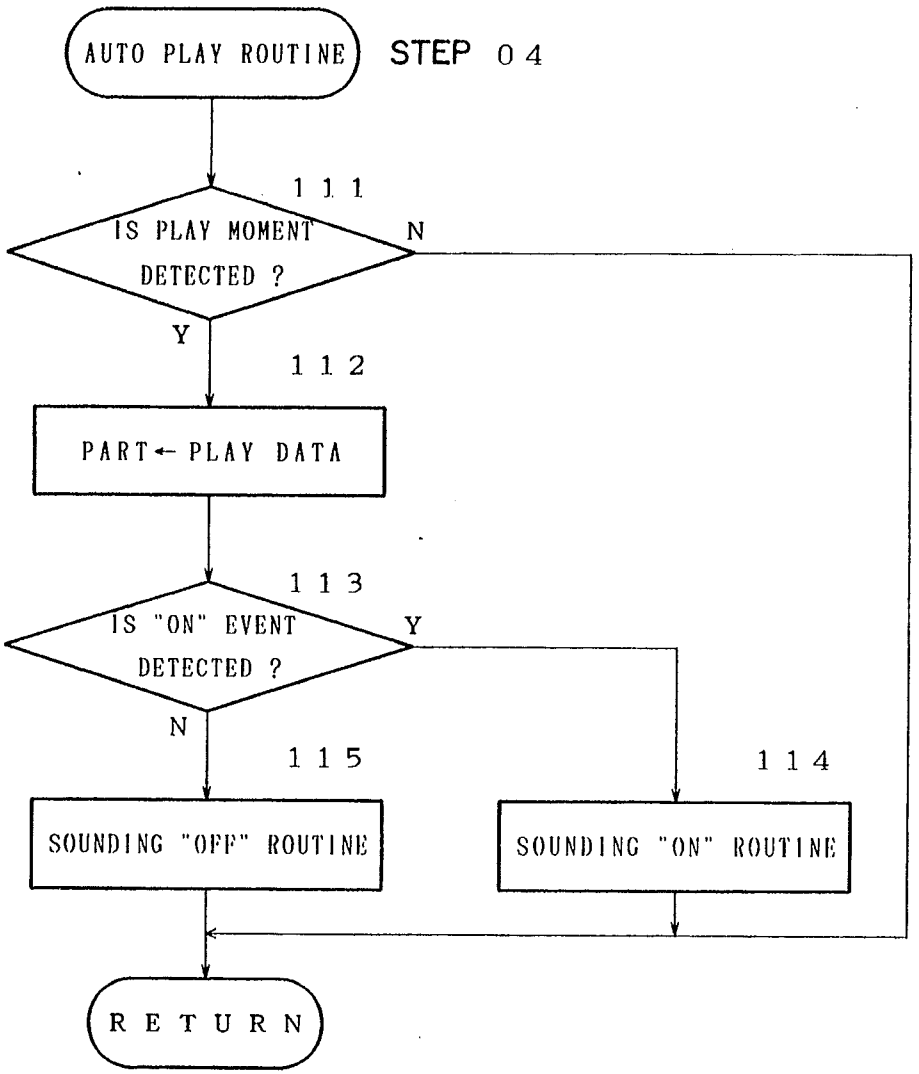
FIG. 17 is a flow chart of an auto play routine.

FIG. 17 is a flow chart showing the auto play routine in step 04. In this routine, it is determined whether the auto play data read from the ROM 7 represents the sounding "on" or "off" moment, i.e., the play moment (step 111). This is determined as follows. An interrupt signal is supplied to the CPU 5 using a programmable timer or the like and in a cycle corresponding to a preset tempo, and the time register in the ROY 6 is incremented in accordance with this signal. If the value in the time register is identical to the step or gate time data in the auto play data, the sounding "on" or "off" routine is executed. The step time data is composed of data from the start or the bars of a piece of music to the sounding "on" moment, and the gate time data is composed of data from the start or the bars of a piece of music to the sounding "off" moment.

If it is found in step 111 that the auto play data represents a play moment, sound part data PART in the read-out auto play data is set in the sound part register 22 (step 112), and it is determined whether the play moment is a sound "on" or "off" moment (step 113). If it is determined that the value in the time register is identical to the step time data, the play moment is a sounding "on" moment, whereas if the value is identical to the gate time data, the play moment is a sounding "off" moment. When the sounding "on" moment is determined, a sounding "on" routine is executed (step 114), and when the sounding "off" moment is determined, a sounding "off" routine is executed (step 115). The sounding "on" routine in the step 114 is executed as in the flow chant shown in FIG. 14. The auto play data includes pitch (key number) data, tone colon (tone number) data, sound pant data PART, velocity data and volume data, as well as the above step and gate time data.

15. Sounding "off" routine

Figure 18:
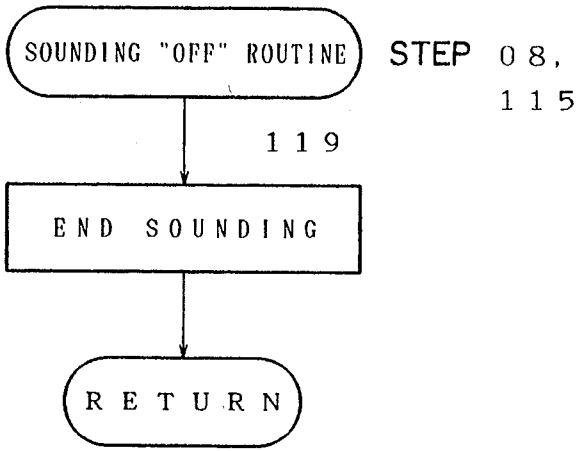
FIG. 18 is a flow chart of a muting routine.

FIG. 18 is a flow chant showing the sounding "off" routine in steps 08, 115, etc. In this routine, the same musical data as that concerning the sounding "off" in the assignment memories 9*a* and 9*b*, is searched, and the thus-detected "on/off" data of the data is made "off" to turn off, i.e., to bring to an end, the sounding (step 119).

Although a preferred embodiment of the invention has been described, the present invention is by no means limited thereto, and various changes and modifications may be made without departing from the spirit and scope of the invention. For example, it is possible to provide a three or more channel stereophonic system by providing three or more loudspeakers in lieu of the loudspeakers 14R and 14L. In this case, three or more pant accumulators, D-A converters, amplifiers and AND gate groups are provided instead of 11R and 11L, 12R and 12L, 13R and 13L and 31*a* and 31*b*, and data of two bits or three or more bits, which can represent four or six or more states, is used as the right/left data R/L of the panning data PAN. In the case of four channels, 3-bit data which can represent six or eight states, is used, the AND gates 31*a*, 31*b*, . . . are switched according to such 3-bit data.

The sound pants as noted above are not limited thereto, and may include externally input MIDI data, "backing", and "arpeggio", etc. in addition to "melody", "chord", "bass", and "drum". Any desired number of different sound parts may be covered. The musical factors used for varying the sound image may be the velocity, pitch (key number), volume, modulation level, tempo and rhythm, as well as the sounding order, sound part, tone color and effect as noted above. In this case, a decoder such as the decoder 20 shown in FIG. 11 is provided for each velocity value range, each key number data octave, each volume range, each modulation level range, each tempo value range, and each rhythm.

Further, it is possible to Vary the sound image shift pattern and so forth, as well as the positions and number of sound images, for a sound image variation. The sound image shift pattern may be realized with an addition or subtraction of periodically varying data to or from the panning data set in the panning circuits 10*a* and 10*b*, and a periodic variation of the value of the added or subtracted data.

We claim:

1. A stereophonic sound system comprising:

sound data generating means for generating sound data;

stereophonic means for converting the sound data generated by said sound data generating means into stereophonic sound data;

a plurality of sounding means for sounding the stereophonic sound data to thereby form at least one sound image;

detecting means for detecting a musical factor of the sound data generated by said sound data generating means;

stereophonic data generating means for generating stereophonic data according to the musical factor detected by said detecting means;

stereophonic data storage means for storing the stereophonic data generated by said stereophonic data generating means; and stereophonic control means for supplying the stereophonic data stored in said stereophonic data storage means to said stereophonic means, to thereby modify the stereophonic sound data to vary a number of the at least one sound image formed by said plurality of sounding means.

2. The stereophonic sound system according to claim 1, wherein the musical factor is a tone color.

3. The stereophonic sound system according to claim 1, wherein the variation of the sound image effected by said stereophonic control means also comprises a variation of a sound image position.

4. The stereophonic sound system according to claim 1, wherein the musical factor is indicative of melody, chord and bass.

5. A method of generating a stereophonic sound comprising the steps of:

(a) generating sound data;

(b) converting the generated sound data into stereophonic sound data;

(c) sounding the stereophonic sound data to thereby form at least one sound image;

(d) detecting a musical factor of the generated sound data;

(e) generating stereophonic data according to the detected musical factor of the generated sound data;

(f) storing the stereophonic data generated in step (e); and (g) modifying the stereophonic sound data according to the stored stereophonic data to vary a number of the at least one sound image formed.

6. The method of generating a stereophonic sound according to claim 5, wherein the variation of the sound image also comprises a variation of a sound image position.

7. The method of generating a stereophonic sound according to claim 5, wherein said step of sounding the stereophonic sound data comprises generating a plurality of simultaneous sound data for a single sounding.

8. The method of generating a stereophonic sound according to claim 7, wherein frequencies of the plurality of simultaneous sound data are different.

9. The method of generating a stereophonic sound according to claim 7, wherein said step of converting the generated sound data comprises controlling one of a generation moment of the plurality of simultaneous sound data and a level of the plurality of simultaneous sound data.

10. The method of generating a stereophonic sound according to claim 5, wherein the stereophonic data comprises a plurality of fixed data, at least one of which is selectively supplied according to the detected musical factor.

11. The method of generating a stereophonic sound according to claim 5, wherein the musical factor is indicative of melody, chord and bass.

12. The method of generating a stereophonic sound according to claim 5, wherein the number of the at least one sound image varies according to a change of a sound part.

13. The method of generating a stereophonic sound according to claim 5, wherein the musical factor is a tone color.

14. A method of generating stereophonic sound comprising the steps of:

generating sound data indicative of desired musical tones to be produced;

generating tone waveform data in accordance with the sound data;

detecting a musical factor of the sound data;

converting the tone waveform data into stereophonic sound data in accordance with the musical factor; and radiating the stereophonic sound data as stereophonic sound to form a plurality of sound images, a number of the plurality of sound images formed varying in accordance with the musical factor.

15. The method of generating stereophonic sound according to claim 14, wherein the musical factor is a sequential generation of the sound data.

16. The method of generating stereophonic sound according to claim 14, wherein the musical factor is a sound part.

17. The method of generating stereophonic sound according to claim 14, wherein the musical factor is a tone color.

18. The method of generating stereophonic sound according to claim 14, wherein the musical factor is an effect.

19. The method of generating stereophonic sound according to claim 14, wherein image positions of the plurality of sound images are varied.

20. The method of generating stereophonic sound according to claim 14, further comprising varying a number of the sound images formed.

21. The method of generating stereophonic sound according to claim 14, wherein the musical factor is indicative of melody, chord or bass.

22. A stereophonic sound system comprising:

sound data generating means for generating sound data;

stereophonic means for converting the sound data generated by said sound data generating means into stereophonic sound data;

a plurality of sound means for sounding the stereophonic sound data to thereby form a sound image;

detecting means for detecting a sequential generation of the sound data generated by said sound data generating means;

sequential generation storage means for storing the sequentially generated sound data detected by said detecting means;

stereophonic data generating means for generating stereophonic data according to the sequentially generated sound data stored in said sequential generation storage means;

stereophonic data storage means for storing the stereophonic data generated by said stereophonic data generating means; and stereophonic control means for supplying the stereophonic data stored in said stereophonic data storage means to said stereophonic means, to thereby modify the stereophonic sound data to vary the sound image formed by said plurality of sounding means.

23. A stereophonic sound system comprising:

sound data generating means for generating sound data;

stereophonic means for converting the sound data generated by said sound data generating means into stereophonic sound data;

a plurality of sounding means for sounding the stereophonic sound data to thereby form a sound image;

detecting means for detecting sound parts of the sound data generated by said sound data generating means;

sound part storage means for storing the sound parts detected by said detecting means;

stereophonic data generating means for generating stereophonic data according to the sound parts stored in said sound part storage means;

stereophonic data storage means for storing the stereophonic data generated by said stereophonic data generating means; and stereophonic control means for supplying the stereophonic data stored in said stereophonic data storage means to said stereophonic means, to thereby modify the stereophonic sound data to vary the sound image formed by said plurality of sounding means.

24. A stereophonic sound system comprising:

sound data generating means for generating sound data;

stereophonic means for converting the sound data generated by said sound data generating means into stereophonic sound data;

a plurality of sounding means for sounding the stereophonic sound data to thereby form a sound image;

detecting means for detecting effects of the sound data generated by said sound data generating means;

effect storage means for storing the effects detected by said detecting means;

stereophonic data generating means for generating stereophonic data according to the effects stored in said effect storage means;

stereophonic data storage means for storing the stereophonic data generated by said stereophonic data generating means; and stereophonic control means for supplying the stereophonic data stored in said stereophonic data storage means to said stereophonic means, to thereby modify the stereophonic sound data to vary the sound image formed by said plurality of sounding means.

25. A method of generating a stereophonic sound comprising the steps of:

(a) generating sound data;

(b) converting the generated sound data into stereophonic sound data;

(c) sounding the stereophonic sound data to thereby form a sound image;

(d) detecting a sequential generation of the generated sound data;

(e) storing the sequentially generated sound data detected in said step (d);

(f) generating stereophonic data according to the stored sequentially generated sound data;

(g) storing the stereophonic data generated in said step (f); and (h) modifying the stereophonic sound data according to the stored stereophonic data to vary the sound image.

26. A method of generating a stereophonic sound comprising the steps of:

(a) generating sound data;

(b) converting the generated sound data into stereophonic sound data;

(c) sounding the stereophonic sound data to thereby form a sound image;

(d) detecting sound parts of the generated sound data;

(e) storing the detected sound parts;

(f) generating stereophonic data according to the stored sound parts;

(g) storing the stereophonic data generated in said step (f); and (h) modifying the stereophonic sound data according to the stored stereophonic data to vary the sound image.

27. A method of generating a stereophonic sound comprising the steps of:

(a) generating sound data;

(b) converting the generated sound data into stereophonic sound data;

(c) sounding the stereophonic sound data to thereby form a sound image;

(d) detecting effects of the generated sound data;

(e) storing the detected effects;

(f) generating stereophonic data according to the stored effects;

(g) storing the stereophonic data generated in said step (f); and (h) modifying the stereophonic sound data according to the stored stereophonic data to vary the sound image.

28. The stereophonic sound system according to claims 22, 23 or 24, wherein the variation of the sound image effected by said stereophonic control means is a variation of a number of sound images formed.

29. The stereophonic sound system according to claims 1, 22, 23 or 24, wherein said sound data generating means generates a plurality of simultaneous sound data for a single sounding operation.

30. The stereophonic sound system according to claim 29, wherein said stereophonic means effects controls frequencies of the plurality of simultaneous sound data differently.

31. The stereophonic sound system according to claim 29, wherein said stereophonic means controls a generation moment of the plurality of simultaneous sound data generated by said sound data generating means.

32. The stereophonic sound system according to claim 29, wherein said stereophonic means controls a level of the plurality of simultaneous sound data generated by said sound data generating means.

33. The stereophonic sound system according to claims 1, 22, 23 or 24, wherein said stereophonic sound data is comprised of a plurality of fixed data, at least one of which is selectively supplied by said stereophonic data generating means to said stereophonic means according to the musical factor detected by said detecting means.

34. The stereophonic sound system according to claims 1, 22, 23 or 24, wherein said stereophonic sound means and said detecting means process a plurality of sound data on a time-division basis.

35. The stereophonic sound system according to claims 1, 22, 23 or 24, wherein said stereophonic data generating means and said stereophonic control means process a plurality of the stereophonic data on a time-division basis.

36. The method of generating a stereophonic sound according to claims 5, 25, 26 or 27, wherein a plurality of sound data are processed on a time-division basis and a plurality of stereophonic data are processed on a time-division basis.

37. The stereophonic sound system according to claim 25, 26 or 27, wherein the variation of the sound image is a variation of a plurality of sound images formed.

38. The stereophonic sound system according to claims 22, 23 or 24, wherein the variation of the sound image effected by said stereophonic control means is a variation of a sound image position.

39. The method of generating a stereophonic sound according to claims 25, 26 or 27, wherein the variation of the sound image is a variation of a sound image position.

* * * * *